United States Patent [19]

Livesay

[11] 4,231,349

[45] Nov. 4, 1980

[54] FIREPLACE HEAT EXCHANGER UNIT

[76] Inventor: Keith Livesay, Rte. 2, Salem, Ill. 62881

[21] Appl. No.: 959,786

[22] Filed: Nov. 13, 1978

[51] Int. Cl.[3] ..... F24B 7/04

[52] U.S. Cl. ..... 126/121; 126/135; 126/139

[58] Field of Search ..... 126/120, 121, 135, 63, 126/66, 67, 126, 136, 138, 139

[56] References Cited

U.S. PATENT DOCUMENTS

| | | | |
|---|---|---|---|
| 394,042 | 12/1888 | Wheeler | 126/121 |
| 438,319 | 10/1890 | Libbey | 126/121 |
| 737,382 | 8/1903 | Frederick | 126/121 |
| 1,740,996 | 12/1929 | Mur | 126/121 |
| 2,131,763 | 10/1938 | Sroat | 126/121 |
| 2,134,935 | 11/1938 | Winnett | 126/121 |
| 2,396,535 | 3/1946 | Rumery | 126/121 |
| 2,703,566 | 3/1955 | Fosel et al. | 126/120 |
| 3,159,157 | 12/1964 | Ponto | 126/121 |
| 3,995,611 | 12/1976 | Nelson | 126/121 |

*Primary Examiner*—Allan N. Shoap

*Attorney, Agent, or Firm*—Cohn, Powell & Hind

[57] ABSTRACT

A fireplace heat exchanger unit including a forward section disposed outside of the fireplace and a rearward section disposed within the fireplace. The forward section provides upper air inlet openings for admitting cool air into an air inlet chamber and a pair of lower air outlet openings having electric blowers for discharging warmed air from air outlet chambers housing electric blowers. The rearward section is generally U-shaped and provides a duct connection between the inlet and outlet chambers. It is disposed about the heat source and the duct connection provides air heating chambers to warm the air during passage from the inlet to the outlet chambers.

9 Claims, 9 Drawing Figures

FIREPLACE HEAT EXCHANGER UNIT

BACKGROUND OF THE INVENTION

This invention relates generally to an improved fireplace heat exchanger unit and more particularly to a unit which can be used in conjunction with existing fireplaces to provide more efficient heating and circulation of air passing through the unit.

Conventional heat exchangers adapted for use in residential fireplaces are frequently complicated in structure and are attached or built into the walls of the fireplace as a permanent unit. Other devices of this type attempt to incorporate the fireplace grate into their structure and thereby provide a configuration which is not adapted to absorb heat from the fire in an optimum manner.

Stili other devices of this type are constructed in such a manner as to deny ease of access to the combustible material.

The present fireplace heat exchanger unit overcomes these and other disadvantages in the known prior art.

SUMMARY OF THE INVENTION

This fireplace heater unit is essentially a self-contained portable unit and may be used for a variety of conventional fireplaces. It is substantially independently supported and does not therefore create any excess pressure on the fireplace walls. The unit is used in conjunction with a conventional grate and is arranged so that the optimum absorption of heat from the fireplace is absorbed into the exchanger. The structural arrangement of parts of this heat exchange unit provides unobstructed access to the combustible material and achieves a highly efficient heat transfer because of the provision and disposition of heating chambers which are directly exposed to the fire source flames and thereby provide for extended heating of the air as it passes through the device.

This heat exchanger unit includes a forward section and a rearward section. The forward section includes an upper generally elongate horizontal portion providing an air inlet chamber having at least one air inlet opening for admitting air into said chamber and a pair of lower generally vertical portions spaced lengthwise of and operatively attached to said upper portion, each providing an air outlet chamber having at least one air outlet opening for discharging air from said air outlet chamber. Said unit also includes a generally U-shaped rearward section including an upper portion providing an upper chamber connected to said air inlet chamber, a pair of side portions providing side chambers connected between said upper chamber and an associated air outlet chamber and a rearward opening substantially defined by said upper and side portions and communicating with said fireplace flue entry. Said unit also includes a pair of blowers, each mounted within an air outlet chamber for drawing air through said air inlet opening and into said air inlet chamber, through said upper and side chambers and into said air outlet chambers for discharge through said air outlet openings.

More particularly, said rearward section upper and side chambers can include inner faces directly exposed to the heat source in the fireplace.

The forward section can be generally triangular in cross section having an inclined front wall providing said air inlet openings.

The rearward section can include side portions which are spaced from the fireplace bottom wall and preclude burning out of the bottom part of said portions.

DESCRIPTION OF THE PREFERRED EMBODIMENT

Figures 1, 2, 3, 4:
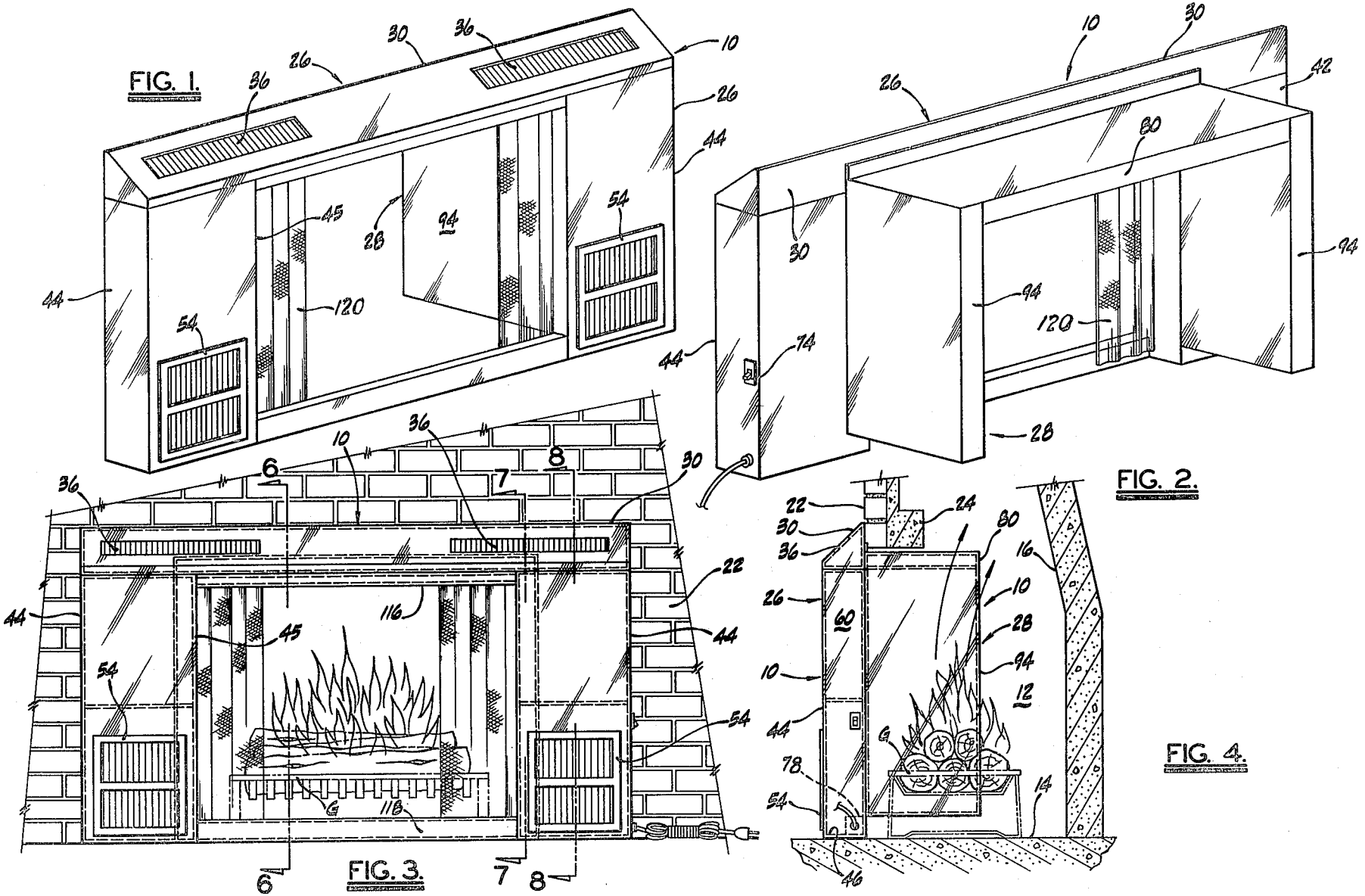
FIG. 1 is a front perspective view of the fireplace heat exchanger unit.
FIG. 2 is a rear perspective view of said unit.
FIG. 3 is a front elevational view of said unit.
FIG. 4 is a side elevational view of said unit.

Referring now by reference numerals to the drawings and first to FIGS. 1–5, it will be understood that the fireplace heater unit, generally indicated by numeral 10, is intended for use within a conventional fireplace, generally indicated by numeral 12. The fireplace 12 consists essentially of a floor or hearth 14, a back wall 16, opposed side walls 18, and ell-shaped upper wall 20, and a front wall 22. As shown in FIG. 4, said upper wall and back wall define a flue opening 24.

Figure 5:
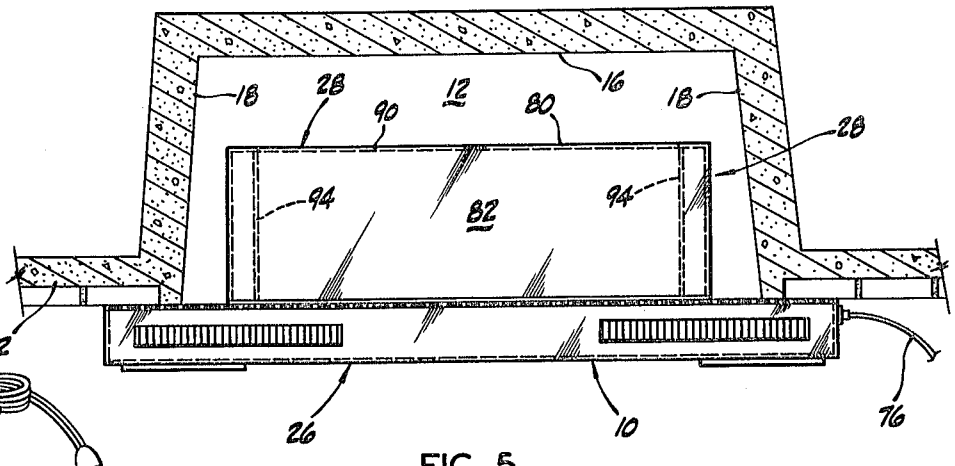
FIG. 5 is a top plan view of said unit.

As clearly shown in FIGS. 4 and 5, the fireplace unit 10, which is formed of sheet metal in the preferred embodiment, includes a forward section 26 disposed in abutting relation with the front wall 22 and a rearward section 28 disposed substantially inside the fireplace 12. The structural relationship of parts of the fireplace unit 10 will now be more specifically described with particular reference to FIGS. 3–8.

Figure 8:
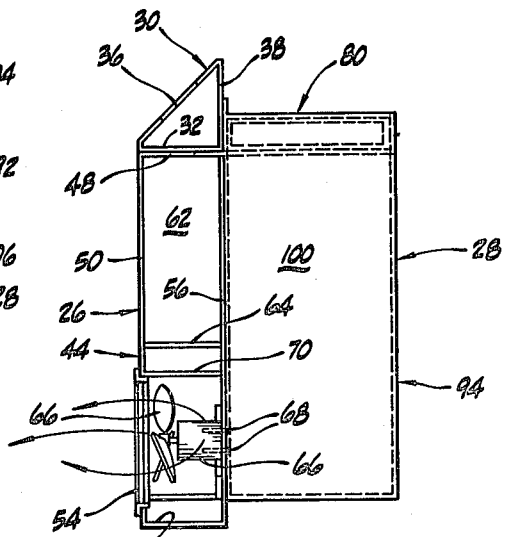
FIG. 8 is a cross-sectional view taken on line 8—8 of FIG. 3.
Figure 9:
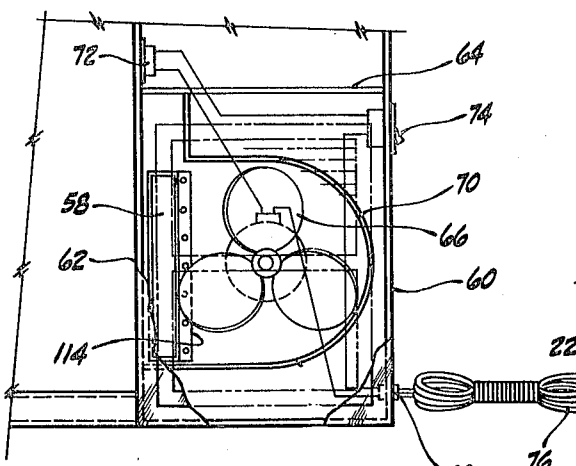
FIG. 9 is an enlarged fragmentary front elevational view of the blower mounted in the air outlet chamber.

The forward section 26 of the fireplace unit 10 includes an upper, generally horizontal portion 30 having a bottom wall 32; an inclined front wall 34, which is provided with a pair of grills 36 constituting air inlet openings; and a rear wall 38, which is provided with a lengthwise, intermediately disposed lower opening 40. The upper portion 30 is closed by end walls 42 and said walls 32, 34, 38, and 42 define an air inlet chamber. The forward section 26 of the fireplace unit 10 also includes a pair of lower, generally vertical side portions 44 disposed in side-by-side relation which are attached to said upper portion 30 and cooperate with said upper portion to define a fireplace front opening 45. The side portions 44, which are substantially identically formed in mirror image to each other, are generally rectangular and each includes a bottom wall 46, which is disposed in seating relation to the fireplace floor 14; an upper wall 48 attached, as by rivets, to the bottom wall 32 of the upper portion 30; a front wall 50, which is provided with a lower opening 52 fitted with a grill cover 54 and constitutes an air outlet discharge opening; and a rear wall 56 having an offset opening 58. Each side portion 44 also includes an outer side wall 60 and an inner side wall 62, and a partition wall 64 extends between said side walls 60 and 62 to define in part an insulation chamber disposed below said air inlet chamber. As shown in FIGS. 8 and 9, the portion of each of the side portions 44 disposed below the partition wall 64 houses a blower, which is provided in the preferred embodiment by an electric fan 66 attached to the rear wall 56 as by bolts 68. A fan shroud, generally indicated by numeral 70 extends between said front and rear walls 50 and 56 of each side portion 44 and cooperates with said front and rear walls and said inner side walls 62 to form an air outlet chamber. In the preferred embodiment, a thermostat control switch 72 is attached to the inner wall 62 of one of the side portions 44 and a toggle switch 74 is disposed on the outer end wall 60 in parallel with the thermostat switch 72 in the electric circuit. As will also be clear from FIG. 9, the electric fan 66 is connected to a power source by means of an electric cord 76. It will be readily understood that the fans 66 are electrically connected in a connection box 78 (FIG. 4) for simultaneous operation upon actuation of the toggle switch 74.

Figure 7:
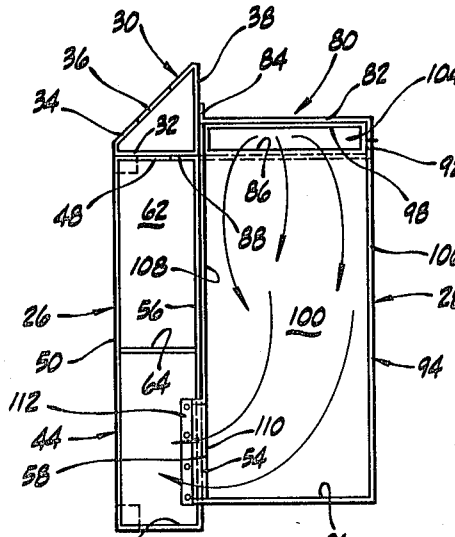
FIG. 7 is a cross-sectional view taken on line 7—7 of FIG. 3.
Figure 6:
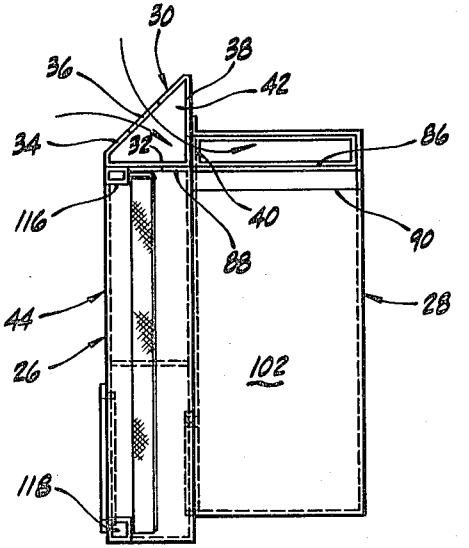
FIG. 6 is a cross-sectional view taken on line 6—6 of FIG. 3.

The air inlet chamber and the air outlet chambers provided by the upper and side portions 30 and 44 respectively of the forward section 26 are interconnected by the rearward section 28 which, in effect, provides a conduit or duct connection between said inlet and outlet chambers. The rearward section 28 is substantially U-shaped, as clearly shown in FIG. 2, and includes an upper portion 80 and a pair of depending side portions 94. As shown in FIG. 7, the upper portion 80 includes an upper wall 82 having an upturned flap 84 by which it is connected to the rear wall 38 of the forward section 26 as by rivets; a lower wall 86, having a forward flap 88 extending between abutting walls 32 and 48 of the upper and side portions of the front section 26; and, as shown in FIG. 6, depending side flaps 90. The upper and lower walls 82 and 86 are connected at their rear end by a rear wall 92 and a corresponding front end is open to communicate with the lower opening 40 provided in the rear wall 38 of the forward section. Each of the side portions 94 includes a lower wall 96; an upper wall 98, to which the upper portion side flaps 90 are attached as by rivets; an outer wall 100; and an inner wall 102 having an opening 104 at its upper end. As shown in FIGS. 6 and 7, the opening 104 communicates with the end openings of the upper portion 80 defined by the upper, lower and rear walls 82, 86, and 92. The outer and inner walls 100 and 102 are interconnected by a rear wall 106 and a front wall 108, said front wall having a lower opening 110 communicating with the offset opening 58 provided in the rear wall 56 of the front section side portions 44. The front wall 108 includes two flaps 112 and 114 which are shown in FIGS. 7 and 9 respectively and are connected to the forward section side portions 44 as by rivets. In effect, the U-shaped rearward section upper portion 80 provides an upper chamber connected to the forward section air inlet chamber and the side portions 94 provide side chambers connecting said upper chamber to the air outlet chamber, said upper and side chambers cooperating to provide a duct connection between said air inlet and outlet chambers.

In the preferred embodiment, as shown in FIGS. 3 and 6, the side portions 44 of the forward section 26 are interconnected by upper and lower tubular members 116 and 118 respectively, and conventional folding mesh screens 120 are provided which are suspended from the forward section upper portion 30 and may be drawn across the fireplace opening as desired.

The configuration of the fireplace heat exchanger unit 10, as described, facilitates installation of the unit in virtually any existing conventional fireplace. For example, as clearly shown in FIGS. 3, 4, and 5, the forward section 26 of the unit is sized to overlap the front wall 22, while the rearward portion 28 is received within the fireplace opening in spaced relation from the side walls 18 and the rear wall 16. In effect, the rearward section 28 of the unit 10 provides a tunnel-like housing for the heat source, which can be provided from a conventional grate G, that is open at the rear end to communicate with the flue opening 24. As shown in FIGS. 6, 7 and 8, for example, the rearward section depending side portions 94 are spaced from the fireplace bottom wall 14 so that the lower part of these portions is not burned out as a result of ash build-up.

As described above, the inner faces of the rearward section 28 are directly heated by flames from the grate G. When the temperature resulting from this heat is sufficiently great, the thermostat switch 72 is automatically closed and when the toggle switch 74 is in the "on" position, the fan 66 is actuated to pull air from the room and through the heat exchanger unit by way of the upper inlet openings 36, the air inlet chamber, and the interconnected upper and side chamber ducts provided by the rearward section 28 and into the air outlet chamber to be discharged by said fan 66 from the discharge air outlet openings 52 and into the room. Because of the discharge of warm air at a low level, there is a general tendency for this air to rise and because of blower action in the unit to circulate through the room and through the unit.

It will, of course, be readily understood that the same basic heat exchanger unit can be made in several different sizes to suit a complete range of conventional fireplaces.

I claim as my invention:

1. A fireplace heat exchanger unit for a fireplace providing a heat source and having opposed sidewalls, front and rear walls, a bottom wall, and an upper flue entry, said unit comprising:

(a) a forward section including:

(1) an upper, generally elongate horizontal portion providing an air inlet chamber having at least one air inlet opening for admitting air into said air inlet chamber, and (2) a pair of lower, generally vertical portions spaced lengthwise of and operatively attached to said upper portion and each providing an air outlet chamber having at least one air outlet opening for discharging air from said air outlet chamber, (b) a generally U-shaped rearward section spaced forwardly of said fireplace rear wall and including:

(1) an upper portion providing an upper chamber connected to said air inlet chamber, (2) a pair of side portions providing side chambers connected between said upper chamber and an associated air outlet chamber, and (3) a rearward opening defined substantially by said upper and side portions, and communicating with said fireplace flue entry, and (c) a pair of blowers each mounted within an air outlet chamber for drawing air through said air inlet opening and into said air inlet chamber, through said upper and side chambers and into the air outlet chambers for discharge through said air outlet openings.

2. A fireplace heat exchanger unit as defined in claim 1, in which:

(d) said rearward section upper chamber and side chambers include inner faces directly exposed to the heat source in the fireplace.

3. A fireplace heat exchanger unit as defined in claim 1, in which:

(d) said forward section upper portion is generally triangular in cross section having an inclined front wall providing said air inlet openings.

4. A fireplace heat exchanger unit as defined in claim 1, in which:

(d) said forward section lower portion includes a pair of insulation chambers disposed between said air inlet chamber and said air outlet chambers.

5. A fireplace heat exchanger unit as defined in claim 4, in which:

(e) said rearward section side chambers include lower openings disposed below said insulation chambers and connecting said side chambers to said air outlet chambers.

6. A fireplace heat exchanger unit as defined in claim 1, in which:

(d) the blowers are thermostatically controlled.

7. A fireplace heat exchanger unit as defined in claim 1, in which:

(d) said rearward section side portions are substantially perpendicular to said forward section and are spaced from the fireplace side walls.

8. A fireplace heat exchanger unit as defined in claim 1, in which:

(d) said forward section upper and lower portions are disposed generally outside of the fireplace and the intermediate portion is disposed generally inside the fireplace.

9. A fireplace heat exchanger unit as defined in claim 1, in which:

(d) said rearward section side portions are spaced from said fireplace bottom wall to preclude burning out of the bottom part of said side portions.

* * * * *